US005575553A

United States Patent [19]

Tipton

[11] Patent Number: 5,575,553

[45] Date of Patent: Nov. 19, 1996

[54] CONTAINER USING FIBER OPTIC IMAGING

[76] Inventor: Tommy B. Tipton, 3433 Darilek Rd., Flatonia, Tex. 78941

[21] Appl. No.: 494,002

[22] Filed: Jun. 23, 1995

[51] Int. Cl.[6] ..... F21V 33/00

[52] U.S. Cl. ..... 362/101; 362/31; 362/154; 362/800; 362/812; 40/324; 40/546

[58] Field of Search ..... 40/546, 324, 326; 362/31, 101, 154, 184, 186, 276, 800, 802, 812, 32, 806, 808

[56] References Cited

U.S. PATENT DOCUMENTS

| | | | |
|---|---|---|---|
| 2,224,319 | 12/1940 | Schroyer | 362/101 |
| 3,218,447 | 11/1965 | Pardue | 362/101 |
| 3,878,386 | 4/1975 | Douglas | 362/101 |
| 4,034,213 | 7/1977 | Norris | 362/200 |
| 4,344,113 | 8/1982 | Ditto et al. | 362/101 |
| 4,390,928 | 6/1983 | Runge | 362/101 |
| 4,563,726 | 1/1986 | Newcomb et al. | 362/34 |
| 4,858,084 | 8/1989 | Sheryll | 362/101 |
| 4,922,355 | 5/1990 | Dietz et al. | 362/101 |
| 5,070,435 | 12/1991 | Weller | 362/101 |
| 5,119,279 | 6/1992 | Makowsky | 362/101 |
| 5,211,699 | 5/1993 | Tipton | 362/101 |

FOREIGN PATENT DOCUMENTS

| | | | |
|---|---|---|---|
| 1516076 | 3/1968 | France | 362/101 |
| 701798 | 1/1941 | Germany | 362/101 |

*Primary Examiner*—Denise L. Gromada
*Assistant Examiner*—Alan B. Cariaso
*Attorney, Agent, or Firm*—Whitham, Curtis, Whitham & McGinn

[57] ABSTRACT

An optically transparent container includes a base, a sidewall extending from the base and having indicia formed as recesses. The recesses are emergent upon an exterior surface of the container and the base includes a sealed compartment. A lighting mechanism housed within the compartment, includes a battery for activating at least one diode disposed beneath a lowermost extremity of the sidewall. A switch mechanism positioned within the compartment includes a touch-sensitive switch for energizing the at least one diode for a predetermined time period when the container is touched. The at least one diode is de-energized when one of the predetermined time period expires and the container is touched subsequently. The at least one light-emitting diode is formed in an orientation which is other than parallel to a bottom surface of the container.

15 Claims, 7 Drawing Sheets

CONTAINER USING FIBER OPTIC IMAGING

BACKGROUND OF THE INVENTION

1. Field of the Invention

This invention is directed to novelty items incorporating fiber optic principles and more particularly to a container having means, using fiber optic principles, for illuminating an etched pattern formed in a sidewall of the container.

2. Description of the Related Art

Pedestal and coaster devices for illuminating a drinking glass seated thereupon to produce a novel lighting effect have been disclosed in U.S. Pat. Nos. 3,878,386; 4,344,113 and 4,858,084. In such devices, the light emergent from the underlying support device is directed upwardly through the center of the glass.

U.S. Pat. Nos. 4,563,726 and 4,922,355 disclose drinking glasses which have light-emitting means incorporated into the bottom of the glass. Similarly to the pedestal-type illuminating devices, the light is directed upwardly through the center of the glass. Such centralized illumination of a beverage in a glass produces a sparkling, or chemiluminescent light effect. Any indicia on the sidewall of the glass is seen as an indistinctive opaque silhouette profile.

Further, a novel lighted drinking glass is disclosed in U.S. Pat. No. 5,211,699, incorporated herein by reference, and which is illustrated in FIG. 6.

This conventional drinking glass illuminates indicia 66 on a sidewall 60 of the glass, and the indicia provides a 3-dimensional or depth effect.

This glass, which is fabricated of a transparent plastic such as polyacrylate or polycarbonate polymer, includes an elongated sidewall 60 having a circular contour with a center axis 61 of symmetry and extending between an uppermost (lip) extremity 62 and a lowermost extremity 63. The sidewall 60 is bounded in part by opposed interior and exterior surfaces 64, 65. Indicia 66, such as an etched pattern for conveying information, advertising or the like, is formed as recesses in the sidewall 60. The recesses are emergent upon the exterior surface and extend in depth partially through the sidewall 60 toward the interior surface 64. The recesses are defined by facets which in part are angled with respect to the axis 61.

A base 70 joins the lowermost extremity of the sidewall 60 as a continuous integral extension thereof, and has an impervious sealable compartment 73 and flat bottom surface 72. A lighting mechanism, housed within the compartment, includes a re-chargeable battery 77 and at least one light-emitting diode 78 activated by the battery 77 and disposed beneath the lowermost extremity 63 of the sidewall 60.

A switch mechanism 79, confined within the compartment, energizes the light-emitting diode 78 when the glass is upright on its base 70, and de-activates the diode when the glass is turned upside down. A removable, sealable access panel, disposed upon the lower surface of the base 70, provides access to the compartment.

In operation, when the drinking glass is in its upside down, stored state, ambient illumination acting upon the solar cells serves to charge the battery.

However, the above drinking glass has several problems. First, the light-emitting diodes are formed in an orientation which is horizontal (e.g., parallel to a bottom surface (e.g., bottom plane) of the glass. Such an orientation is difficult to manufacture precisely and the molding technique of the glass is cumbersome and very time-consuming.

The LED positioned horizontally is mounted into or inside a horizontal cavity. This cavity is in the opposite direction of the general mold. The mold is manufactured to split along the vertical length of the glass. Thus, the structural part of the glass in a horizontal direction requires extensive mold changes, thereby creating a more complicated mold with more mold pieces (to include a plurality of "gates" etc.). Thus, the mold will not only open and close to the vertical main structure, but also requires a second molding action (and mold portion) for the horizontal cavity, which is time-consuming and costly. Thus, molding the horizontal structure (e.g., parallel to the bottom of the glass) is disadvantageous.

A second disadvantage of the conventional glass is that the glass is activated only by use of a simple gravity switch. The gravity switch only energizes the light-emitting diode when the glass is upright on its base portion, and deactivates the diode when the glass is turned upside down.

Thus, the glass is operational in an upright position and to deactivate the glass the glass must be affirmatively grasped by the operator and tilted upside down or at the very least tilted to a predetermined angle (e.g., as in drinking) for the illumination of the indicia to be terminated. Hence, such a gravity switch degrades the ability of the glass to be selectively illuminated (e.g., a significant and desired portion of the time), and thus diminishes the advertising and pleasing effects of the glass.

With the tilt switch, the glass remains lit at all times when the glass is in the upright position. The glass cannot be turned off unless it is turned over, which is troublesome if a beverage is in the glass.

Further, it is impossible for a user to drink from the glass without the glass being illuminated. Thus, there is no capability to use the glass so as to be selectively illuminated such that the glass can be nonilluminated and still be used as a beverage container or drinking glass. Hence, an advertising or pleasing effect cannot be obtained in each and every orientation of the conventional glass.

SUMMARY OF THE INVENTION

In view of the foregoing problems of the conventional containers, it is an object of the present invention to provide a container having a sidewall containing indicia which can be intensely and selectively illuminated and which provides a 3-dimensional or depth effect.

It is another object of the present invention to provide a container having a lighting mechanism incorporated into the bottom of the glass and which is easily manufactured.

Yet another object of the present invention is to provide a container having a lighting mechanism (e.g., light-emitting diodes) formed in an orientation which is other than horizontal (e.g., parallel to a bottom surface (e.g., bottom plane) of the container and more preferably a lighting mechanism having a vertical (e..g, perpendicular) orientation in which the LED(s) form a 90-degree angle with the bottom plane of the container.

Still another object of the present invention is to provide a container having a switch which is operable by means of motion, light and/or sound and which need not be affirmatively grasped and tilted by an operator in order to cause the indicia on the container to become illuminated.

In a first aspect, a container according to the present invention includes a base portion; a sidewall portion extending from the base and having indicia formed as recesses, said recesses emergent upon an exterior surface of the container, the base portion comprising a sealed compartment. A lighting mechanism housed within the compartment includes a battery and at least one light-emitting diode disposed beneath a lowermost extremity of the sidewall portion, the at least one diode being activated by the battery. A switch mechanism positioned within the compartment comprises a touch-sensitive switch for energizing the at least one light-emitting diode for a predetermined time period when the container is touched. The at least one diode is de-energized one of when the predetermined time period expires and the container is touched subsequently.

In another aspect, the container according to the present invention includes a lighting mechanism including at least one light-emitting diode which is formed in an orientation which is other than horizontal (e.g., parallel to a bottom surface (e.g., bottom plane)) of the container and more preferably a lighting mechanism having a vertical (e..g, perpendicular) orientation in which the LED(s) form a 90-degree angle with the bottom plane of the container.

With the structure of the invention, a container is formed which is easily manufactured, has improved illumination effects and which is easily activated.

Further, by using the inventive structure, any image etched or embossed into the container glows, thereby providing excellent use as an advertising tool as well as allowing the user to easily and reliably grasp the container in dimly lit or dark rooms.

BRIEF DESCRIPTION OF THE DRAWINGS

The foregoing and other objects, aspects and advantages will be better understood from the following detailed description of a preferred embodiment of the invention with reference to the drawings, in which.

DESCRIPTION OF THE PREFERRED EMBODIMENTS

Referring to FIGS. 1 and 2A–2C, a first embodiment of the container according to the present invention is shown.

For the exemplary embodiments, the container includes a drinking glass. Of course, as is dearly evident to one of ordinary skill in the art within the purview of this application, the container may include any type of vessel and moreover the fiber optic principles of this invention may be easily extended to any type of transparent material having an image etched or embossed thereon which is designed to convey information (the image and/or data) to the viewer.

Figure 1:
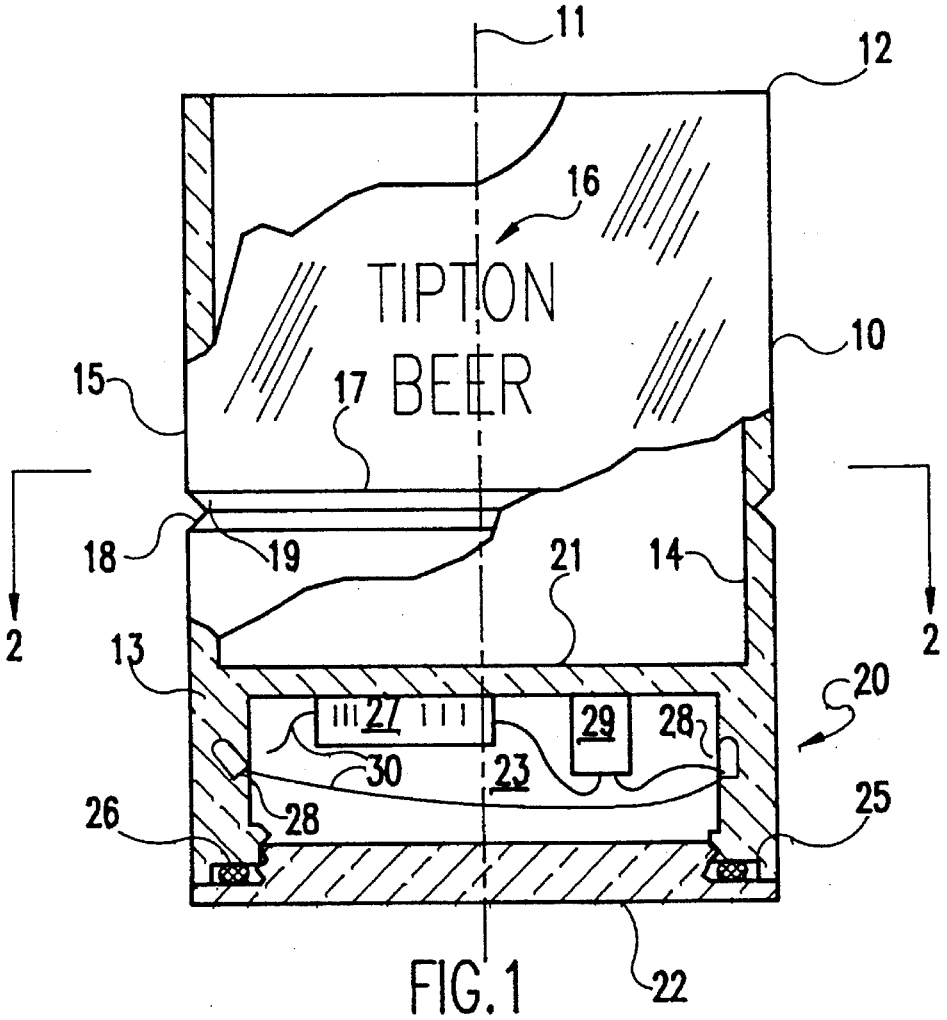
FIG. 1 is a partial vertical sectional view of a container (e.g., drinking glass) according to the present invention.

The glass shown in FIG. 1 includes an elongated sidewall portion 10 of circular cylindrical contour having a center axis of symmetry 11 and extending between an uppermost lip extremity 12 and a lowermost extremity 13. The sidewall portion is bounded in part by opposed interior and exterior surfaces 14 and 15, respectively.

Indicia 16, which may include logos, advertising data or the like, is engraved into exterior surface 15. In the illustrated embodiment, a decorative engraved band 17 encircles the sidewall as part of indicia 16. The nature of the engraving is such that, when magnified, a V or wedge-shaped contour 18 is carved, molded or otherwise formed in the sidewall in a manner whereby the walls or facets of the wedge are angled with respect to axis 11. The innermost penetration of the engraving, or apex 19 of the wedge configuration may be located at a distance within the sidewall representing between about 10% and 40% of the thickness of the sidewall. The indicia 16 is similarly engraved so as to have facets angularly disposed to the axis.

A base portion 20 joins the lowermost extremity of the sidewall portion as a continuous integral extension thereof.

The base portion, in the embodiment of FIGS. 1 and 2A–2C, is bounded in part by opaque upper panel 21 that joins with the sidewall to form therewith a liquid-impervious vessel, and a flat lower panel 22 orthogonally disposed to the axis and defining with said upper panel an impervious sealable compartment 23.

In the illustrated embodiment, lower panel 22 further serves as a threadably removable disc which acts in conjunction with O-ring 25 and annular abutment shoulder 26 to form an impervious closure of compartment 23.

Figure 2A:
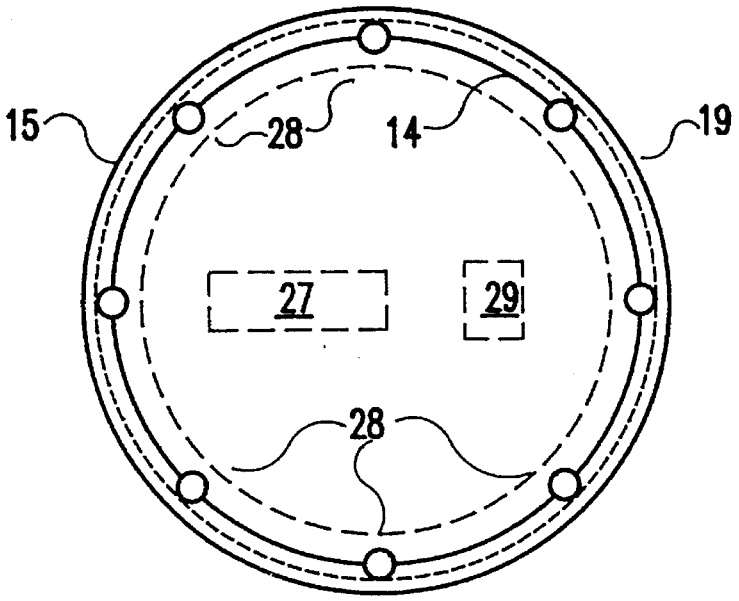
FIG. 2A is a horizontal sectional view taken in the direction of the arrows upon the line 2—2 of FIG. 1 and FIGS. 2B and 2C illustrate the base portion of the container in greater detail.
Figure 2B:
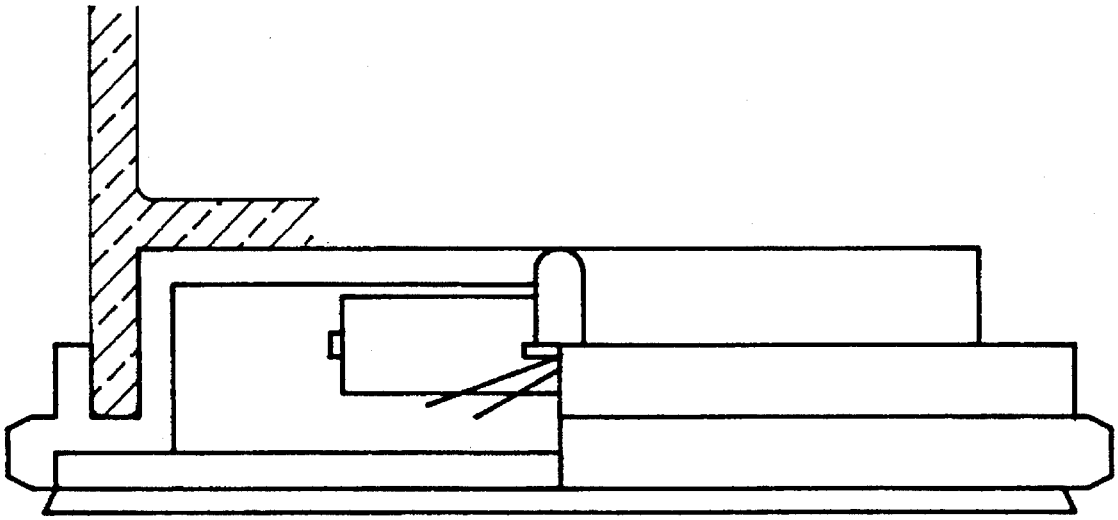
Figure 2C:
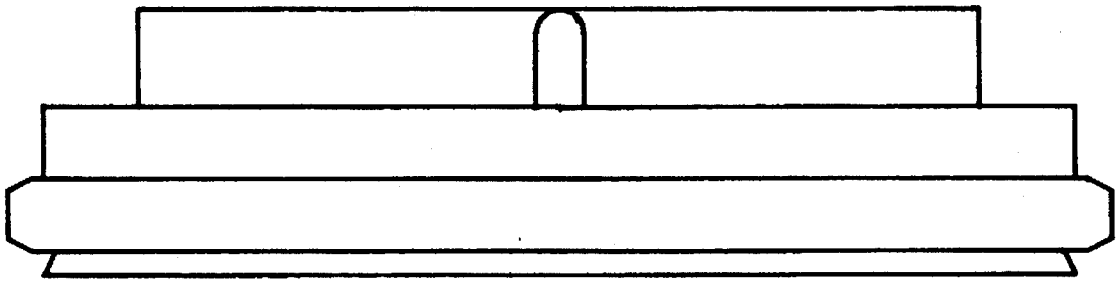

The base may be modified as shown in greater detail in FIGS. 2B and 2C to snap onto the glass, as opposed to being integrally formed with the glass. This allows the glass to be washed without the battery/electronics coupled thereto and thereby avoiding any short-circuiting of the device. With such modifications, indentations may be provided on the base so as to allow the easy removal of the base (and thus the battery and electronics).

Thus, the structure of FIGS. 2B and 2C also allows easy removal of the battery and electronics of the glass. More specifically, as briefly mentioned above, indentations on the base portion allow the battery and LED electronics to be removed so as to, for example, wash the glass. Removing the battery and electronics will greatly safeguard the components from extreme heat distributed by commercial dishwashers and/or from the high water pressure from the same. Further, battery life is saved by the glass being prevented from being illuminated from motion during washing by the removal of the battery and electronics.

A lighting mechanism positioned and confined within compartment 23 includes a re-chargeable battery 27 and at least one light-emitting diode (LED) 28 activated by the battery. If more than one LED is employed, the LEDs are equidistantly disposed in a circular array beneath sidewall portion 10.

More specifically, the light-emitting diodes are formed in an orientation which is other than horizontal (e.g., parallel to a bottom surface (e.g., bottom plane)). Preferably, as shown in FIGS. 1, 2A–2C, and 4, the lighting mechanism has a vertical (e..g, perpendicular) orientation in which the LED(s) form a 90-degree angle with the bottom plane of the container.

Figure 4:
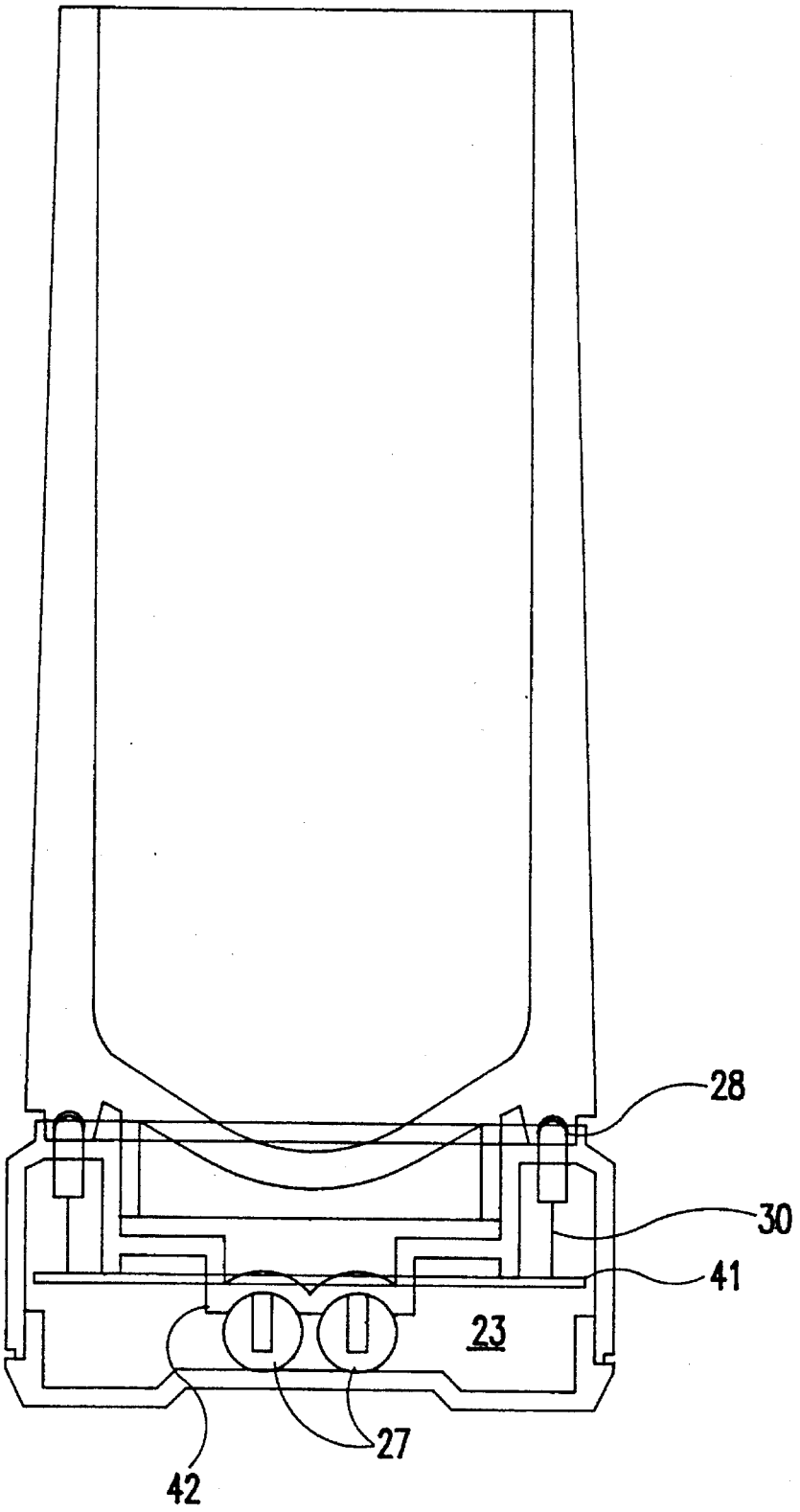
FIG. 4 is a partial vertical sectional view of an embodiment of a container (e.g., drinking glass) of the present invention illustrating the switching mechanism in greater detail.

Specifically, as shown in FIG. 4, for example, the light emitting diode(s) 28 are mounted "vertically" (e.g., parallel to the length of the glass and perpendicular to a bottom surface of the glass). This arrangement allows a greater efficiency of transmission of the light throughout the glass. For exemplary purposes, FIG. 1 illustrates a first LED in a vertical orientation, whereas a second LED is illustrated having an orientation of between the vertical orientation and the horizontal orientation. Preferably, the base is polished to a high degree (e.g., perfectly) at the insertion point of the LEDs and prior to forming the LEDs therein. The base is preferably not frosted so as to retain superior light transmission qualities.

Returning to FIG. 4, a semiconductor circuit board 41 in combination with battery holders 42 eliminates the need for wire connections between the switch and the batteries and promotes ease of assembly and reduced cost of assembly. Using wire to connect the electronics is commonly employed yet such a method is labor-intensive and thus manufacturing costs are raised. In contrast, circuit boards require less effort to install and connect and therefore decrease manufacturing time. Circuit boards are also precisely manufactured to fit precisely and perfectly and are less likely to weaken at connections, thereby providing a stronger end product.

By providing an orientation other than an horizontal orientation, a much brighter illumination results. Specifically, the sidewall of the glass receives a beam from LED 28 which is focussed and directed to the indicia 16.

Figure 6:
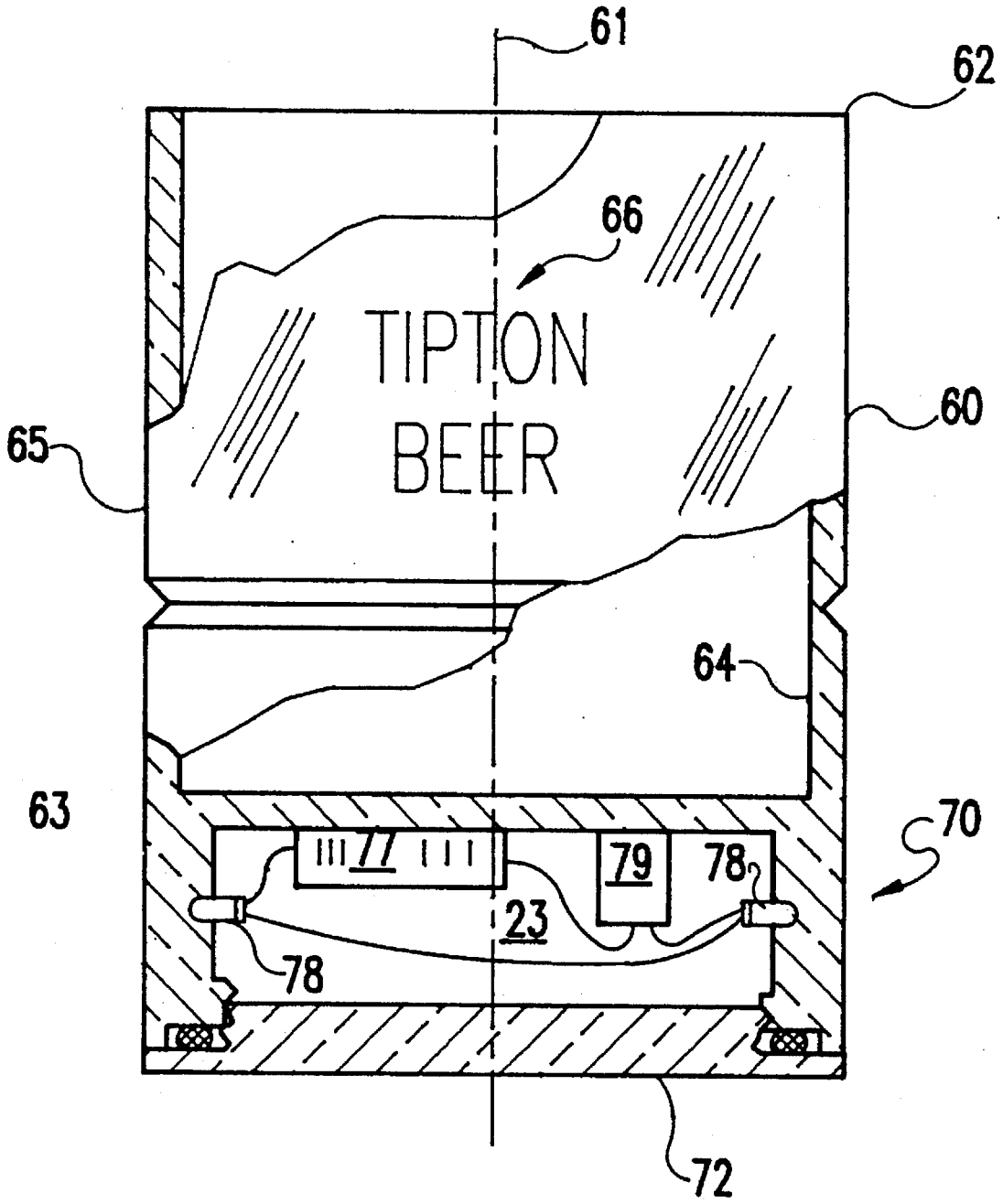
FIG.6 PRIOR ART
FIG. 6 illustrates a conventional container (e.g., drinking glass).

Specifically, the sidewall functions as an optical fiber (or coupler) for carrying the beam emitted by the LED directly to the indicia. With a vertical or non-horizontal orientation of the LED, reflection and propagation of the beam (e.g., bouncing back and forth along the sidewall and thus consequent light energy loss) is minimized. Instead, the beam is directly output to the indicia 16 perpendicularly to the bottom surface of the glass and along the sidewall to provide a stronger, illuminated image as compared to the conventional container shown in FIG. 6. Moreover, there is no need to treat the glass with a film (or cladding) on its exterior to prevent light from being lost as it is emitted to the indicia. More specifically, no light is lost on the clear surface. The only place where light exits the glass is at a break, scratch or seam whereby the light can reflect from the non-clear surface. Thus, no film is required by the invention.

Further, by providing an orientation other than at a horizontal orientation, it is much easier to manufacture the container according to the present invention because the molding process is much simpler.

Specifically, most molds have two portions which split open at the center. All sections of the finished glass should be easily molded in one vertical direction. Any parts or cavity requiring horizontal molding requires a much more complicated mold. With vertical LED cavity orientation, no changes in mold movement or performance are required, unlike horizontal molding in combination with vertical molding in one. One-way vertical molding requires a less complicated mold, less moving parts and less manufacturing and set-up time.

The invention also includes an improved switch mechanism. As mentioned above, the conventional switch 79 is confined within compartment 63 and is adapted to complete an electrical circuit between the battery and diodes when the glass is upright and disconnect the circuit when the glass is turned upside down whereby the glass rests upon the lip of the sidewall.

More specifically, this switch is based on a mercury tilt-switch having, for example, a funnel-shaped structure with a track or ball race. A small circular member (e.g., a ball or B-B-shaped member) is received and retainably secured on the track or ball race, so as to roll back and forth thereon. The ball is in a first position when the glass is upright and rolls to a second position when the glass is tilted. In the conventional glass, electrical conductors 70, which may be wires or printed conductive paths, complete the circuitry between the switch, battery and diodes, by the ball closing the electrical circuit upon tilting the glass upside down.

However, in contrast to the conventional glass, the inventive container includes the switch mechanism 29 which comprises a touch-sensitive or motion switch. The electrical details and configuration of such switches are known in the art and, for brevity, will not be disclosed herein. In lieu of or in addition to the touch-sensitive/motion-switch, a light-sensitive switch, a sound-sensitive switch or other similar switch may be suitably employed.

With such a switch, the lighting mechanism is illuminated by a user by simply touching the glass or by a sound such as the user's voice. The switch preferably deactivates the illumination of the indicia after a predetermined time period (e.g., one minute) by a suitable sensing device employed with a printed circuit board (PCB) with a timer or the like. Alternatively, the switch can be deactivated by a second touch or a second sound being applied thereto. Further, the illumination of the glass can be turned off immediately or to operate in a "pulsing" manner by suitably adjusting the electronics (e.g., the timer, etc.) on the PCB.

In certain embodiments, a charging socket may penetrate compartment 23 in a manner to re-charge battery 27. Also, solar cells may be incorporated into compartment 23, facing toward disc 24, so that, when the glass is upside down, the cells will utilize ambient light to re-charge the battery. The base portion is otherwise opaque, thereby concealing the contents of compartment 23.

In operation, when the glass is right side up, the light emitted from the LED(s) passes upwardly through the sidewall, and emerges at the sites of engraving. The angled facets of the engraving reflect light outwardly from the glass, thereby creating a very distinctive lighting effect. Such an effect is enhanced by opaque upper panel 21 of the base portion, which prevents light from entering the interior region of the glass and tends to concentrate the light in the sidewall. As light travels through the wall of the container, it exits only where an image is etched or embossed, which causes the image to glow. The rest of the glass remains clear except for the rim of the glass where in the light exits. Thus, when a carbonated beverage is poured into the glass, thousands of effervescent bubbles also transport light, creating a sparkling effect.

Further, by having a vertical or non-horizontal orientation of the LED, reflection and propagation of the beam is minimized and the sidewall carries the beam emitted by the LED directly to the indicia. Moreover, the beam is directly output to the indicia 16 perpendicularly to the bottom surface of the glass and along the sidewall to provide a strongly and clearly illuminated image as compared to the conventional system shown in FIG. 6. Further, by providing an orientation other than an horizontal orientation, it is much easier to manufacture the container according to the present invention because the molding process is much simpler. Additionally, the assembly process takes a shorter amount of time to install LEDs straight into the glass instead of inserting them into the sidewall from a horizontal position.

Figure 3:
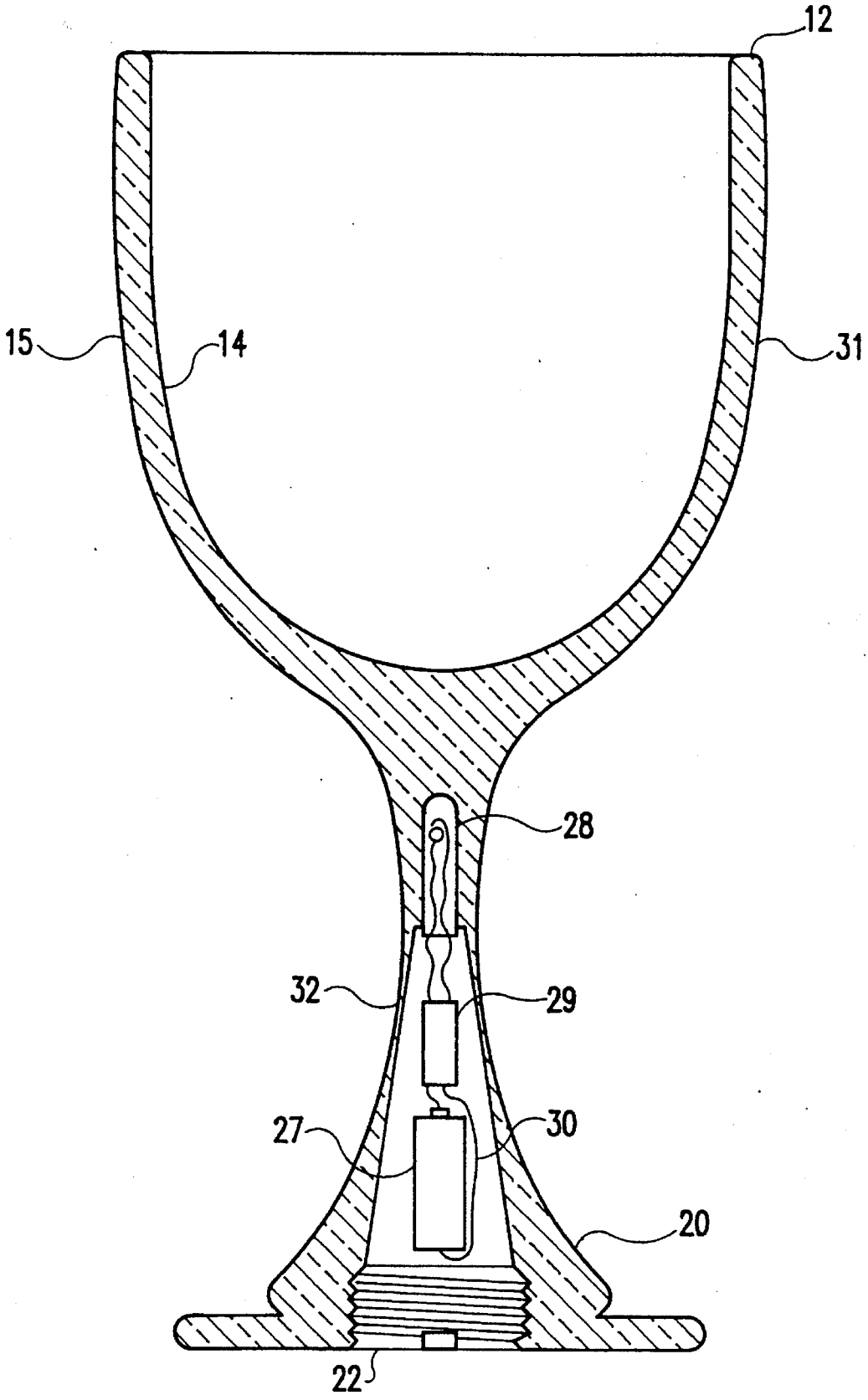
FIG. 3 is a vertical sectional view of an alternative embodiment of the container (e.g., drinking glass) of the present invention.

In the alternative embodiment of FIG. 3, the same general principles that have been described with respect to a tubulartype cylindrical-walled drinking glass are applied to a stemmed wine glass. In the case of the wine glass, a single diode is employed where the bottom the curved vessel portion 31 attaches to stem portion 32. The lighting system is incorporated into the stem portion. Once again, the diode is oriented to emit light perpendicular to a base of the glass.

Another feature of the invention is a plurality of attachments for connection to the glass. The attachments are suitable for use as novelty items which evoke a desired theme or motif. Examples of such attachments are shown in FIG. 5A and 5B.

Figure 5A:
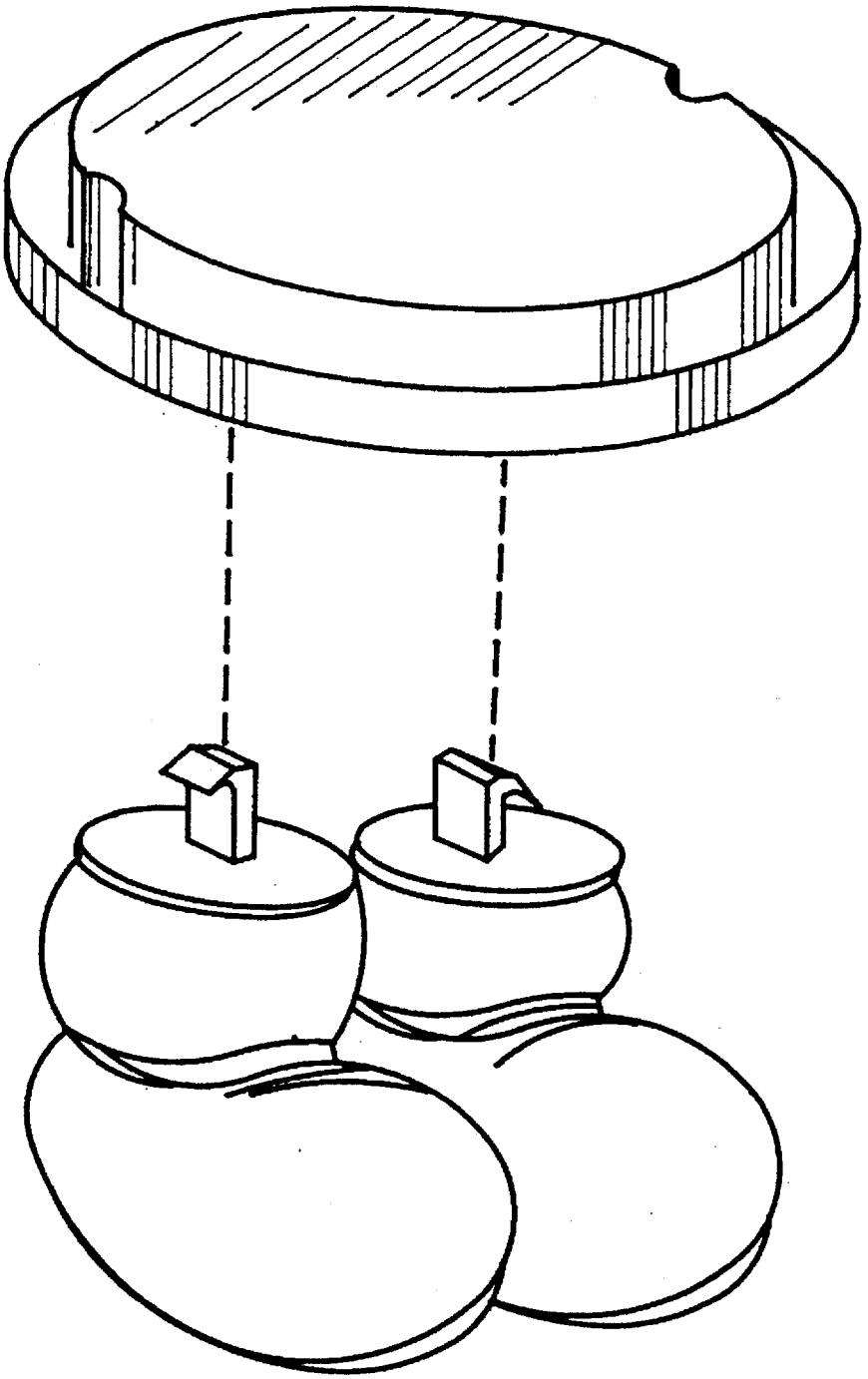
FIGS. 5A and 5B illustrate attachments for connection to the container.

For example, FIG. 5A illustrates shoes for connection to the base 20 of the inventive container. Specifically, hooks 51 formed on the tops of each of the shoes are for engaging suitable cavities formed in the base. A suitable ejection mechanism (not illustrated) may also be provided to allow the attachment to be easily ejected or removed from the base and so that other attachments can be employed in place of one another.

Figure 5B:
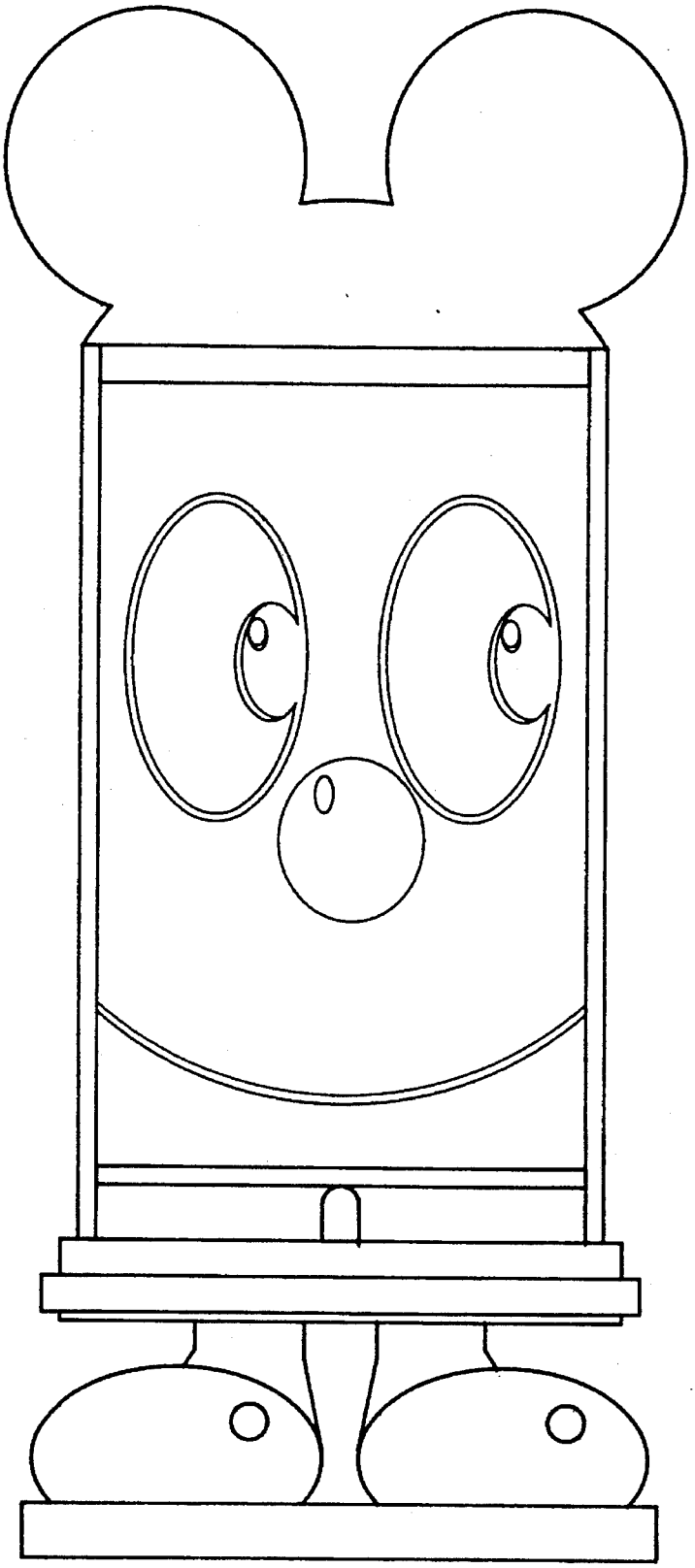

FIG. 5B illustrates another example of an attachment in which a hat having ears are placed over the lip of the glass and are snapped on thereto. With such an attachment, a straw, insertable through a hole (not illustrated) formed in the top of the hat, is employed for drinking a beverage in the glass. A plurality of attachments may be used either alone or in combination, as desired.

Further, a handle may be used on the container to form a mug.

Thus, with the structure according to the present invention as described above, a container is provided having a sidewall containing indicia which can be intensely and selectively illuminated and which provides a 3-dimensional or depth effect. Further, the container has a lighting mechanism incorporated into the bottom of the glass and which is easily manufactured. Moreover, with the present invention, the container has a lighting mechanism (e.g., light-emitting diodes) formed in an orientation which is other than horizontal (e.g., parallel to a bottom surface (e.g., bottom plane) of the container and more preferably the lighting mechanism has a vertical (e..g, perpendicular) orientation in which the LED(s) form a 90-degree angle with the bottom plane of the container.

Furthermore, the container preferably has a switch which is operable by means of touch, motion, light and/or sound and which need not be affirmatively grasped and tilted by an operator in order to cause the indicia on the container to become illuminated. Thus, with the structure of the invention, a container is formed which is easily manufactured, has improved illumination effects and which is easily activated.

Further, by using the inventive structure, any image etched or embossed into the container glows, thereby providing excellent use as an advertising tool as well as allowing the user to easily and reliably grasp the container in dimly lit or dark rooms.

Moreover, the glass can be selectively operational in an upright position or otherwise. More specifically, the inventive switch allows the glass to be selectively illuminated, and thus preserves the advertising and pleasing effects of the glass. Further, a user may drink from the glass without the glass being illuminated and thus the glass can be illuminated or nonilluminated and still can be used as a beverage container or drinking glass.

While the invention has been described in terms of several preferred embodiments, those skilled in the art will recognize that the invention can be practiced with modification within the spirit and scope of the appended claims.

Having thus described my invention, what is claimed is:

1. An optically transparent container, comprising:

a base;

a sidewall extending from said base and having indicia formed as recesses, said recesses being emergent upon an exterior surface of said container, said base comprising a sealed compartment;

a lighting mechanism housed within said compartment and including a battery and at least one diode disposed beneath said sidewall, said at least one diode being operatively connected to and activated by said battery; and a switch mechanism positioned within said compartment and comprising a touch-sensitive switch, operatively connected to said battery and said at least one diode, for energizing said at least one diode for a predetermined time period when the container is touched, wherein said at least one diode is de-energized when one of said predetermined time period expires and said container is subsequently touched.

2. A container according to claim 1, wherein said at least one light-emitting diode is formed in an orientation which is other than parallel to a bottom surface of the container.

3. A container according to claim 2, wherein said at least one light-emitting diode is formed in an orientation which is perpendicular to the bottom surface of the container.

4. A container, comprising:

a base;

a sidewall extending from said base and having indicia formed as recesses, said recesses being emergent upon a surface of said container, said base comprising a sealed compartment;

a lighting mechanism housed within said compartment and including a battery and at least one light-emitting diode disposed beneath an extremity of said sidewall, said at least one diode being activated by said battery; and a switch mechanism positioned within said compartment and comprising means for energizing said at least one light-emitting diode for a predetermined time period when the container is actuated, wherein said at least one light-emitting diode is formed in an orientation which is other than parallel to a bottom surface of the container, wherein said switch mechanism comprises a touch-sensitive switch for energizing said at least one diode for a predetermined time period when the container is touched.

5. A container according to claim 4, wherein said at least one light-emitting diode is formed in an orientation which is perpendicular to the bottom surface of the container.

6. A container according to claim 4, wherein said at least one diode is de-energized when one of said predetermined time period expires and said container is subsequently touched.

7. A container, comprising:

an elongated sidewall of circular cylindrical contour having a center axis of symmetry and extending between an uppermost lip extremity and a lowermost extremity, said sidewall being bounded in part by opposed interior and exterior surfaces, indicia formed as recesses in said sidewall, a base joining the lowermost extremity of the sidewall as a continuous integral extension thereof, said base comprising:

an opaque upper panel that joins with said sidewall to constitute therewith a liquid-impervious vessel, an impervious sealable compartment, and a flat lower panel, a lighting mechanism housed within said compartment and comprised of a battery and at least one light-emitting diode disposed beneath the lowermost extremity of said sidewall, said at least one diode being activated by said battery;

a switch mechanism confined within said compartment and including means for energizing said at least one light-emitting diode when at least one of the glass is upright on its base, when one of a user touches the container and when the container is moved, and means for de-energizing said at least one light-emitting diode when at least one of a user touches the container for a second time, when the container is moved a second time and after expiration of a predetermined time period; and a threadably removable, sealable access panel associated with said base to provide access to said compartment.

8. A container according to claim 7, wherein said at least one light-emitting diode is formed in an orientation which is other than parallel to a bottom surface of the container.

9. A container according to claim 8, wherein said at least one light-emitting diode is formed in an orientation which is perpendicular to the bottom surface of the container.

10. A container according to claim 9, wherein said recesses are emergent upon said exterior surface and extending in depth between about 10% and 40% through said sidewall toward said interior surface, said recesses defined by facets which in part are angled with respect to said axis.

11. A container according to claim 10, wherein said container is fabricated of optically transparent plastic material.

12. A container according to claim 11, wherein a plurality of light-emitting diodes are provided, said plurality of light-emitting diodes being equidistantly spaced about said sidewall.

13. A container according to claim 4, wherein said diode emits a light beam which is other than parallel to a plane formed by said bottom surface of said container.

14. A container according to claim 13, wherein said light beam is transmitted directly from said diode to said indicia by said sidewall.

15. A container according to claim 13, wherein said light beam is perpendicular to said plane formed by said bottom surface of said container.

* * * * *